US010332448B2

(12) United States Patent
Yue et al.

(10) Patent No.: US 10,332,448 B2
(45) Date of Patent: Jun. 25, 2019

(54) PIXEL CIRCUIT, PIXEL DRIVING METHOD AND DISPLAY DEVICE

(71) Applicant: BOE TECHNOLOGY GROUP CO., LTD., Beijing (CN)

(72) Inventors: Han Yue, Beijing (CN); Jie Fu, Beijing (CN); Shengji Yang, Beijing (CN); Lei Wang, Beijing (CN); Pengcheng Lu, Beijing (CN); Dongni Liu, Beijing (CN); Li Xiao, Beijing (CN); Xiaochuan Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/736,018

(22) PCT Filed: Jun. 20, 2017

(86) PCT No.: PCT/CN2017/089214
§ 371 (c)(1),
(2) Date: Dec. 13, 2017

(87) PCT Pub. No.: WO2018/120679
PCT Pub. Date: Jul. 5, 2018

(65) Prior Publication Data

US 2019/0005878 A1 Jan. 3, 2019

(30) Foreign Application Priority Data

Dec. 29, 2016 (CN) ..... 2016 1 1247392

(51) Int. Cl.
*G09G 3/3233* (2016.01)
*G09G 3/3225* (2016.01)

(52) U.S. Cl.
CPC ..... *G09G 3/3233* (2013.01); *G09G 3/3225* (2013.01); *G09G 2330/04* (2013.01); *G09G 2330/10* (2013.01)

(58) Field of Classification Search
CPC ..... G09G 3/3233; G09G 2330/04; G09G 2330/10
See application file for complete search history.

(56) References Cited

U.S. PATENT DOCUMENTS 7,995,912 B2 8/2011 Yanai et al.
8,237,641 B2 8/2012 Yanai et al.
(Continued)

FOREIGN PATENT DOCUMENTS

CN 1991949 A 7/2007
CN 101276528 A 10/2008
(Continued)

OTHER PUBLICATIONS

First Office Action for Chinese Patent Application No. 201611247392.7 dated Sep. 28, 2017.
(Continued)

*Primary Examiner* — Premal R Patel
(74) *Attorney, Agent, or Firm* — Calfee, Halter & Griswold LLP

(57) ABSTRACT

A pixel circuit includes a light emitting device, a driving circuit configured to drive the light emitting device to emit light, a short circuit control circuit and a light emitting control circuit, wherein the short circuit control circuit is coupled between the light emitting control device and the light emitting device for obtaining an input terminal signal of the light emitting device and outputting a short circuit control signal according to the input terminal signal of the light emitting device, the light emitting control device is coupled to the short circuit control circuit and coupled in
(Continued)

series between the driving circuit and the light emitting device and configured to control a connecting branch between the driving circuit and the light emitting device to be turned on and off according to a short circuit control signal.

19 Claims, 2 Drawing Sheets

(56) References Cited

U.S. PATENT DOCUMENTS

| | | | |
|---|---|---|---|
| 8,441,420 | B2 | 5/2013 | Kim et al. |
| 9,202,853 | B2 | 12/2015 | Kim et al. |
| 2006/0061625 | A1 | 3/2006 | Kim et al. |
| 2007/0146254 | A1 | 6/2007 | Yanai et al. |
| 2011/0285305 | A1 | 11/2011 | Yanai et al. |
| 2013/0221339 | A1 | 8/2013 | Kim et al. |
| 2015/0062199 | A1* | 3/2015 | Ryu ..... G09G 3/3233 345/690 |
| 2015/0339975 | A1* | 11/2015 | Liu ..... G09G 5/10 345/204 |

FOREIGN PATENT DOCUMENTS

| | | | |
|---|---|---|---|
| CN | 104167181 | A | 11/2014 |
| CN | 106486041 | A | 3/2017 |
| CN | 106531071 | A | 3/2017 |
| CN | 106531080 | A | 3/2017 |
| CN | 206301579 | U | 7/2017 |
| CN | 206301580 | U | 7/2017 |

OTHER PUBLICATIONS

Search Report and Written Opinion for International Application No. PCT/CN2017/089214 dated Sep. 4, 2017.

* cited by examiner

PIXEL CIRCUIT, PIXEL DRIVING METHOD AND DISPLAY DEVICE

CROSS-REFERENCE TO RELATED APPLICATIONS

The present application is based on International Application No. PCT/CN2017/089214, filed on Jun. 20, 2017, which is based upon and claims priority to Chinese Patent Application No. 201611247392.7, titled "PIXEL CIRCUIT, PIXEL DRIVING METHOD AND DISPLAY DEVICE" filed Dec. 29, 2016, and the entire contents thereof are incorporated herein by reference.

TECHNICAL FIELD

The present disclosure relates to the field of display technology, and more particularly, to a pixel circuit, a pixel driving method and a display device.

BACKGROUND

An Active Matrix Organic Light Emitting Diode (AMOLED) is more and more widely used. The pixel display device of an AMOLED is an organic light-emitting diode (OLED). The AMOLED can emit light by driving a thin film transistor in a saturated state to generate a driving current, and the driving current drives the OLED to emit light.

In the related art, at least the following problems exist. In the pixel circuit of the OLED, as the film layers between the anode and the cathode are thin, the anode and the cathode are susceptible to short circuit. Moreover, the manufacturing process is complicated, and if there are foreign matters in the films, or the processes of digging holes and climbing are not controlled appropriately, the film in the light emitting layer will be thinner. Thus, the resistance between the anode and cathode of the OLED is smaller, resulting in a short circuit. If the anode and the cathode of a pixel cathode are short circuit, this pixel will not emit light, resulting in a black spot. Moreover, a large current will flow through the pixel, affecting the surrounding pixels to emit light. Therefore, the short circuit between the cathode and the cathode can seriously affect the display quality. In order to ensure the display quality, this defective pixel needs to be removed in order to restrain the large current caused by the short circuit between the anode and the cathode. The traditional way is to find the defective pixel, and then to destroy the pixel by laser ablation, and the process is complicated.

It should be noted that, information disclosed in the above background portion is provided only for better understanding of the background of the present disclosure, and thus it may contain information that does not form the prior art known by those ordinary skilled in the art.

SUMMARY

The present disclosure provides a pixel circuit comprising a light emitting device, a driving circuit configured to drive the light emitting device to emit light, a short circuit control circuit and a light emitting control circuit, wherein the short circuit control circuit is coupled between the light emitting control device and the light emitting device for obtaining an input terminal signal of the light emitting device and outputting a short circuit control signal according to the input terminal signal of the light emitting device, the light emitting control device is coupled to the short circuit control circuit and coupled in series between the driving circuit and the light emitting device and configured to control a connecting branch between the driving circuit and the light emitting device to be turned on and off according to a short circuit control signal.

In one embodiment, an input terminal of the light emitting device is coupled to an output terminal of the light emitting control device and an input terminal of the short circuit control circuit, an output terminal of the light emitting device is coupled to a second power terminal; an input terminal of the driving circuit is coupled to a first power terminal, an output terminal of the driving circuit is coupled to an input terminal of the light emitting control device; and an output terminal of the short circuit control circuit is coupled to a control terminal of the light emitting control device.

In one embodiment, the short circuit control circuit comprises a short circuit protection portion and a precharging portion coupled in series; during a operating phase of the light emitting device, when an input terminal signal of the light emitting device is lower than a threshold value, the short circuit protection portion controls the light emitting control device to be turned off; and during a non-operating phase of light emitting device, the precharging portion controls the light emission control device to be turned on.

In one embodiment, the short circuit protection portion comprises a fourth transistor and a fifth transistor, a control electrode of the fourth transistor is coupled to a first control line, a first electrode of the fourth transistor is coupled to a second electrode of the fifth transistor and the precharging portion, a second electrode of the fourth transistor is coupled to a second control line, a control electrode of the fifth transistor is coupled to the light emitting control device and the light emitting device, and a first electrode of the fifth transistor is coupled to a third control line.

In one embodiment, the precharging portion comprises a sixth transistor, a seventh transistor, an eighth transistor and a second capacitor; a first terminal of the second capacitor is coupled to the light emitting control device and a first electrode of the sixth transistor, a second terminal of the second capacitor is coupled to a second electrode of the eighth transistor and a first electrode of the seventh transistor; a control electrode of the eighth transistor is coupled to an eighth control line and a first electrode of the eighth transistor is coupled to the short circuit protection portion; a control electrode of the seventh transistor is coupled to a fifth control line and a second electrode of the seventh transistor is coupled to a seventh control line; and a control electrode of the sixth transistor is coupled to a fourth control line and a second electrode of the sixth transistor is coupled to a sixth control line.

In one embodiment, a width-length ratio and a threshold voltage of the fourth transistor are respectively the same as those of the fifth transistor.

In one embodiment, the light emitting control device comprises a third transistor, a control electrode is coupled to the short circuit control circuit, a first electrode of the third transistor is coupled to the driving circuit, and a second electrode of the third transistor is coupled to the light emitting device.

In one embodiment, wherein the driving circuit comprises a first transistor, a second transistor and a first capacitor; a control electrode of the first transistor is coupled to the gate line, a first electrode of the first transistor is coupled to a data line, a second electrode of the first transistor is coupled to a first terminal of the first capacitor and a control electrode of the second transistor; and a first electrode of the second transistor is coupled to a first power terminal and a second terminal of the first capacitor, and a second electrode of the second transistor is coupled to the light emitting control device.

The present disclosure also provides a display device comprising the above described pixel circuit.

The present disclosure also provides a method for driving a pixel circuit, adopting the above described pixel circuit, the method for driving a pixel circuit comprising: during an operating phase of the light emitting device, the driving circuit driving the light emitting device to emit light; the short circuit control circuit obtaining an input terminal signal of the light emitting device and outputting a short circuit control signal according to the input terminal signal of the light emitting device, and according to the short circuit control signal, the light emitting control device controlling a connecting branch between the driving circuit and the light emitting device to be turned on and off.

In one embodiment, the short circuit control circuit comprises a short circuit protection portion and a precharging portion coupled in series; the method for driving a pixel circuit further comprising: during a non-operating phase of the light emitting device, the precharging portion controlling the light emitting control device to be turned on.

The pixel circuit in the present disclosure includes a light emitting device, a driving circuit configured to drive the light emitting device to emit light, a short circuit control circuit and a light emitting control circuit, wherein the short circuit control circuit is coupled between the light emitting control device and the light emitting device for obtaining an input terminal signal of the light emitting device and outputting a short circuit control signal according to the input terminal signal of the light emitting device, the light emitting control device is coupled to the short circuit control circuit and coupled in series between the driving circuit and the light emitting device and configured to control a connecting branch between the driving circuit and the light emitting device to be turned on and off according to a short circuit control signal.

DRIVING CIRCUIT SHORT CIRCUIT CONTROL CIRCUIT

Detailed Description

In order to make those skilled in the art better understand the technical solutions of the present disclosure, the present disclosure will be further described in detail below with reference to the accompanying drawings and specific embodiments.

The First Embodiment

Figure 1:
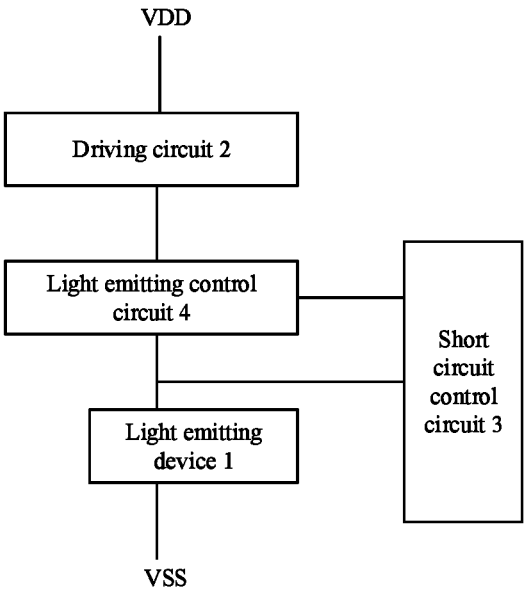
FIG. 1 is a schematic diagram illustrating a pixel circuit according to a first embodiment of the present disclosure.

The present embodiment provides a pixel circuit. As shown in FIG. 1, the pixel circuit includes a light emitting device 1, a driving circuit 2 configured to drive the light emitting device to emit light, a short circuit control circuit 3 and a light emission control device 4. The short circuit control circuit 3 is coupled or connected between the light emitting control device 4 and the light emitting device 1 for obtaining the input terminal signal of the light emitting device 1 and outputting a short circuit control signal according to the input terminal signal of the light emitting device 1. The light emitting control device 4 is connected to the short circuit control circuit 3 and connected in series between the driving circuit 2 and the light emitting device 1 for controlling the turning on and off of the connecting branch between the driving circuit 2 and the light emitting device 1 according to a short circuit control signal. Specifically, the input terminal of light emitting device 1 is connected to the output terminal of the light emitting control device 4 and the input terminal of the short circuit control circuit 3. The output terminal of the light emitting device 1 is connected to the second power terminal VSS and the input terminal of the driving circuit 2 is connected to the first power terminal VDD. The output terminal of the driving circuit 2 is coupled to an input terminal of the light emitting control device 4 and the output terminal of the short circuit control circuit 3 is coupled to a control terminal of the light emitting control device 4.

In the pixel circuit of the present embodiment, as a circuit at megohm level, the light emitting device 1 is coupled in series in the pixel circuit. If a short circuit occurs, the resistance of the light emitting device 1 is reduced or even decreased to zero. The signal of the input terminal of the light emitting device drops, that is, the anode potential drops and is closed to the voltage of the power supply terminal VSS. Then the short circuit control circuit 3 controls the light emitting control devices 4 coupled in series in the light emitting circuit to be turned off and performs short circuit protection. Compared to the method of laser ablation, the pixel circuit of the present disclosure is simple and easy to control, eliminating the need to add a laser ablation device.

The Second Embodiment

Figure 2:
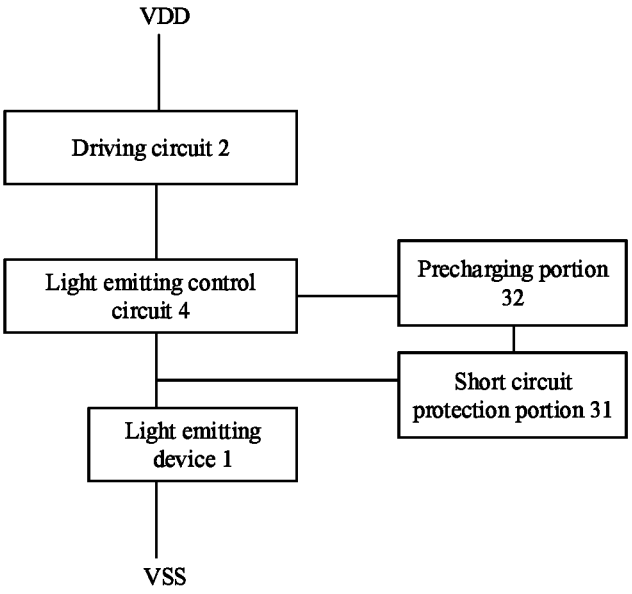
FIGS. 2 and 3 are schematic diagrams illustrating a pixel circuit according to a second embodiment of the present disclosure.

The present embodiment provides a pixel circuit. As shown in FIG. 2, the pixel circuit includes a light emitting device 1, a driving circuit 2, a short circuit control circuit 3, and a light emitting control circuit 4. The short circuit control circuit 3 includes a short circuit protection portion 31 and a precharging portion 32 connected in series. Specifically, the light emitting device 1 is coupled or connected to the light emitting control device 4, the short circuit control circuit 3 and the second power terminal VSS. The driving circuit 2 is coupled to the first power terminal VDD and the light emitting control device 4 for driving the light emitting device 1 to emit light. The short circuit control circuit 3 connects the light emitting device 1 and the light emitting control device 4. The light emitting control device 4 connects the light emitting device 1, the driving circuit 2 and the short circuit control circuit 3. During the operating phase of the light emitting device 1, when the anode potential of the light emitting device 1 is lower than a threshold value, the short circuit protection portion 31 controls the light emitting control device 4 to be turned off. During the non-operating phase of the light emitting device, the precharging portion 32 controls the light emission control device 4 to be turned on.

In the present embodiment, the first power terminal VDD is used to provide the operating voltage and the second power terminal VSS is used to provide the reference voltage. Usually, the voltage level of the first power terminal VDD is high, and it may serve as an anode. The voltage level of the second power terminal VSS is low, and it may serve as a cathode.

It should be noted that the light emitting device 1 in this embodiment may be a current driven light emitting device including a light emitting diode (LED) or an OLED (Organic Light Emitting Diode) in the related art. In this embodiment, an OLED is taken as an example for description.

Figure 3:
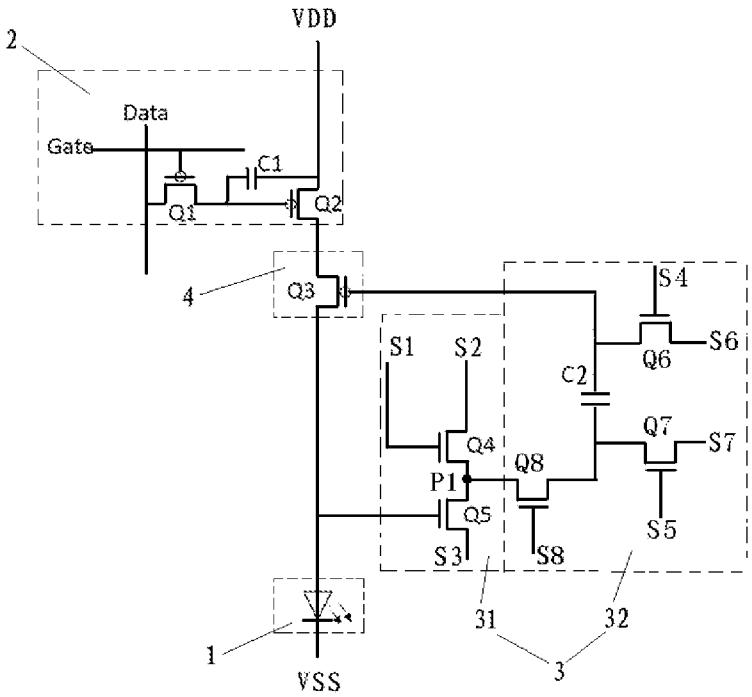

As shown in FIG. 3, as an implementation in this embodiment, the driving circuit 2 includes a first transistor Q1, a second transistor Q2 and a first capacitor C1.

The control electrode of the first transistor Q1 is coupled to the gate line. The first electrode of the first transistor Q1 is coupled to a data line. The second electrode of the first transistor Q1 is coupled to a first terminal of the first capacitor C1 and the control electrode of the second transistor Q2.

The first electrode of the second transistor Q2 is coupled to the first power terminal and the second terminal of the first capacitor C1. The second electrode of the second transistor Q2 is coupled to the light emitting control device 4.

In this embodiment, the first transistor Q1 and the second transistor Q2 are both P-type transistors.

The first transistor Q1 is a switch transistor, the second transistor Q2 is a driving transistor, and the switch of the first transistor Q1 is controlled by a signal applied from the Gate terminal.

As another implementation in this embodiment, the light emitting control device 4 includes a third transistor Q3. The control electrode of the third transistor Q3 is coupled to the short circuit control circuit 3. The first electrode of the third transistor Q3 is coupled to the driving circuit 2. The second electrode of the third transistor Q3 is coupled to light emitting device 1.

That is, the control electrode of the third transistor Q3 is controlled by the output of the short circuit control circuit 3 so as to control the turning on and off of the light emitting circuit of the OLED.

As another implementation in this embodiment, the precharging portion 32 includes a sixth transistor Q6, a seventh transistor Q7, an eighth transistor Q8 and a second capacitor C2.

The first terminal of the second capacitor C2 is coupled to the light emitting control device 4 and the first electrode of the sixth transistor Q6. The second terminal of the second capacitor C2 is coupled to the second electrode of the eighth transistor Q8 and the first electrode of the seventh transistor Q7.

The control electrode of the eighth transistor Q8 is coupled to the eighth control line S8 and the first electrode of the eighth transistor Q8 is coupled to the short circuit protection portion 31.

The control electrode of the seventh transistor Q7 is coupled to the fifth control line S5 and a second electrode of the seventh transistor Q7 is coupled to the seventh control line S7.

The control electrode of the sixth transistor Q6 is coupled to the fourth control line S4 and the second electrode of the sixth transistor Q6 is coupled to the sixth control line S6.

As another implementation in this embodiment, the sixth transistor Q6, the seventh transistor Q7 and the eighth transistor Q8 are both N-type transistors, and the third transistor Q3 is a P-type transistor.

Figure 4:
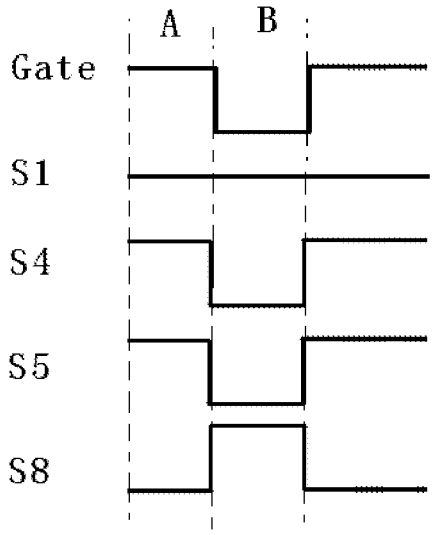
FIG. 4 is a timing diagram of a pixel circuit according to a second embodiment of the present disclosure.

Thus, a frame is divided into two phases A and B. As shown in FIG. 4, the phase A is the non-operating phase of the light emitting device 1 and the phase B is the operating phase of light emitting device 1.

During the non-operating phase A of the light emitting device 1, that is, before the effective signal of the switching signal terminal Gate is inputted, the eighth control line S8 inputs an invalid voltage signal, and the first transistor Q1, the second transistor Q2, and the eighth transistor Q8 are all turned off. The fourth control line S4 and the fifth control line S5 input a valid voltage signal, so that Q6 and Q7 are turned on. The sixth control line S6 and the seventh control line S7 are transmitted to two terminals of the capacitor, then the second capacitor C2 is charged. VS6−Vanode 1<−Vth3 so that the voltage of the sixth control line S6 turns on the third transistor Q3, where the Vanode 1 is the input signal of the light emitting device 1 which is at the non-operating phase, that is the anode signal, and the Vth3 is the threshold voltage of the third transistor Q3.

In other words, by turning on the third transistor Q3 during the non-operating phase of the light emitting device 1, it can ensure that the input signal branch is conductive during the initial operating phase of the light emitting device so that the light emitting signal can be smoothly transmitted to the light emitting device and the misjudgment of the short circuit protection portion 31 can be prevented.

In the present embodiment, the sixth transistor Q6, the seventh transistor Q7, the eighth transistor Q8 and the third transistor Q3 may be selected from other types of transistors.

As another implementation in this embodiment, the short circuit protection portion 31 includes a fourth transistor Q4 and a fifth transistor Q5. The control electrode of the fourth transistor Q4 is coupled to the first control line S1. The first electrode of the fourth transistor Q4 is coupled to a second electrode of the fifth transistor Q5 and the precharging portion 32. The second electrode of the fourth transistor Q4 is coupled to the second control line S2. The control electrode of the fifth transistor Q5 is coupled to the light emitting control device 4 and the light emitting device 1. The first electrode of the fifth transistor Q5 is coupled to the third control line S3.

In one implementation, the width-length ratio and the threshold voltage of the fourth transistor Q4 are the same as those of the fifth transistor Q5.

In this way, during the operating phase B of light emitting device 1, the valid signal at the Gate terminal is provided, and the light emitting signal is transmitted to the light emitting device via the third transistor Q3, thus the light emitting device operates.

As another implementation in this embodiment, the third transistor Q3 is a P-type transistor, the fourth transistor Q4 and the fifth transistor Q5 are both N-type transistors. The first transistor Q1, the second transistor Q2, the fourth transistor Q4, the fifth transistor Q5 and the eighth transistor Q8 are all turned on and the sixth transistor Q6 and the seventh transistor Q7 are turned off.

The width-length ratio and the threshold voltage $V_{th}$ of the fourth transistor Q4 are the same as those of the fifth transistor Q5. The control electrode of the fourth transistor Q4 is controlled by the voltage $V_{S1}$ of the first control line S1, the second electrode of the fourth transistor Q4 is controlled by the voltage $V_{S2}$ of the second control line S2, the first electrode of the fifth transistor Q5 is controlled by the voltage $V_{S3}$ of the third control line S3, and the control electrode of the fifth transistor Q5 is controlled by the anode voltage $V_{anode}$ of the OLED.

The second control line S2 is grounded. The setting value of $V_{S1}$ enables the fourth transistor Q4 and the fifth transistor Q5 to operate in the saturation region. The gate voltage and source voltage of the fourth transistor Q4 and the fifth transistor Q5 are required to be greater than $V_{th}$, the gate voltage and source voltage are smaller than $V_{th}$, $V_{S1}-V_{S2}\leq V_{th4}$, $V_{S1}-V_{P1}\geq V_{th4}$, $V_{anode}-V_{P1}\leq V_{th5}$, $V_{anode}-V_{S3}\geq V_{th5}$, the $V_{anode}$ is the input signal of the light emitting device at this time, that is the anode potential, the $V_{th4}$ is the threshold voltages of the fourth transistor Q4, and the $V_{th5}$ is the threshold voltages of the fifth transistor Q5.

The current flowing through Q4 and Q5 is the same, so $\frac{1}{2}\mu\times(W/L)4\times(V_{S1}-V_{P1}-V_{th4})2=\frac{1}{2}\mu(W/L)5\times(V_{anode}-V_{S3}-V_{th5})2$.

Where, the (W/L)4 is the width-length ratio of the fourth transistor Q4 and the (W/L)5 is the width-length ratio of the fifth transistor Q5.

Since (W/L)4=(W/L)5, $V_{S1}-V_{P1}=V_{anode}-V_{S3}$.

Thus, $V_{anode}=V_{S1}-V_{P1}+V_{S3}$ that is the $V_{anode}$ is decreased and the $V_{P1}$ is increased.

According to the bootstrapping of the capacitor, $V_{gate3}=V_{S6}-V_{S7}+V_{P1}$, $V_{gate3}=V_{S6}-V_{S7}+V_{P1}=V_{S6}-V_{S7}+V_{S1}-V_{anode}+V_{S3}$.

If the light emitting device 1 is operating normally, $V_{gate3}=V_{S6}-V_{S7}+V_{S1}-V_{anode\ 2}+V_{S3}$.

The $V_{anode\ 2}$ is the anode voltage value of the light emitting device which is operating normally, that is a high level signal, $V_{gate3}-V_{anode\ 2}=V_{S6}-V_{S7}+V_{S1}-2V_{anode\ 2}+V_{S3}$, thus $V_{gate3}-V_{anode\ 2}$ is a low level signal.

$V_{gate3}-V_{anode\ 2}<-V_{th3}$, then the third transistor Q3 is turned on.

If the light emitting device 1 occurs short circuit, $V_{gate3}=V_{S6}-V_{S7}+V_{S1}-V_{anode\ 3}+V_{S3}$.

The $V_{anode\ 3}$ is the anode voltage value of the light emitting device which occurs short circuit, that is a low level signal approximating VSS, $V_{gate3}-V_{anode\ 3}=V_{S6}-V_{S7}+V_{S1}-2V_{anode\ 3}+V_{S3}$, thus $V_{gate}-V_{anode\ 3}$ is a high level signal, $V_{gate3}-V_{anode\ 3}>-V_{th3}$, then the third transistor Q3 is turned off.

As another implementation in this embodiment, the third transistor Q3, the fourth transistor Q4, and the fifth transistor Q5 may also be other types of transistors.

Compared with the method of laser ablation, the pixel circuit of the present embodiment is simple and easy to control, eliminating the need for adding a laser ablation device.

It should be noted that, in this embodiment, the first transistor Q1, the second transistor Q2, the third transistor Q3, the fourth transistor Q4, the fifth transistor Q5, the sixth transistor Q6, the seventh transistor Q7 and the eighth transistor Q8 are independently selected from one of polycrystalline silicon thin film transistor, amorphous silicon thin film transistor, oxide thin film transistor, and organic thin film transistor. Each transistor includes a gate, a source, and a drain. The gate is a control electrode. The source and the drain are usually determined by the current direction, and there is no difference in their structure. Therefore, in this embodiment, the first electrode and the second electrode refer to the source and the drain of the transistor, respectively. The source and the drain of the transistor are not limited as long as they are respectively coupled to the required positions.

The Third Embodiment

This embodiment provides a method for driving a pixel circuit, which adopts the above pixel circuit. FIG. 4 shows the timing diagram of a pixel circuit according to this embodiment. The method for driving a pixel circuit includes the following steps.

During the operating phase of the light emitting device 1, the short circuit control circuit obtains the input signal of the light emitting device and outputs a short circuit control signal according to the input signal of the light emitting device. According to the short circuit control signal, the light emitting control device controls the connecting branch of the driving circuit and the light emitting device to be turned on and off.

Compared with the method of laser ablation, the method in this embodiment is simple and easy, and no additional laser ablation device is needed.

Further, the short circuit control circuit comprises a short circuit protection portion and a precharging portion which are coupled in series, and the method for driving a pixel circuit further includes: during the non-operating phase of light emitting device, the precharging portion controls the light emitting control device to be turned on.

The Fourth Embodiment

This embodiment provides a display device which includes any one of the pixel circuits described above. The display device may be any product or component having a display function such as an electronic paper, an OLED panel, a cell phone, a tablet, a television, a display, a notebook computer, a digital photo frame and a navigator.

It can be understood that the above embodiments are merely exemplary embodiments used for illustrating the principle of the present disclosure, but the present disclosure is not limited thereto. For those skilled in the art, various variations and improvements can be made without departing from the spirit and essence of the present disclosure, and these variations and modifications are also considered as the protection scope of the present disclosure.

What is claimed is:

1. A pixel circuit, comprising a light emitting device, a driving circuit configured to drive the light emitting device to emit light, a short circuit control circuit and a light emitting control circuit, wherein the short circuit control circuit is coupled between the light emitting control circuit and the light emitting device for obtaining an input terminal signal of the light emitting device and outputting a short circuit control signal according to the input terminal signal of the light emitting device, the light emitting control circuit is coupled to the short circuit control circuit and coupled in series between the driving circuit and the light emitting device and is configured to control a connecting branch between the driving circuit and the light emitting device to be turned on and off according to the short circuit control signal, wherein the short circuit control circuit comprises a short circuit protection circuit and a precharging circuit coupled in series; during an operating phase of the light emitting device, when an input terminal signal of the light emitting device is lower than a threshold value, the short circuit protection circuit controls the light emitting control circuit to be turned off; and during a non-operating phase of light emitting device, the precharging circuit controls the light emission control device to be turned on.

2. The pixel circuit according to claim 1, wherein an input terminal of the light emitting device is coupled to an output terminal of the light emitting control circuit and an input terminal of the short circuit control circuit, an output terminal of the light emitting device is coupled to a second power terminal;

an input terminal of the driving circuit is coupled to a first power terminal, an output terminal of the driving circuit is coupled to an input terminal of the light emitting control circuit; and an output terminal of the short circuit control circuit is coupled to a control terminal of the light emitting control circuit.

3. The pixel circuit according to claim 2, wherein the light emitting control circuit comprises a third transistor, a control electrode of the third transistor is coupled to the short circuit control circuit, a first electrode of the third transistor is coupled to the driving circuit, and a second electrode of the third transistor is coupled to the light emitting device.

4. The pixel circuit according to claim 2 wherein the driving circuit comprises a first transistor, a second transistor and a first capacitor;

a control electrode of the first transistor is coupled to a gate line, a first electrode of the first transistor is coupled to a data line, a second electrode of the first transistor is coupled to a first terminal of the first capacitor and a control electrode of the second transistor; and a first electrode of the second transistor is coupled to a first power terminal and a second terminal of the first capacitor, and a second electrode of the second transistor is coupled to the light emitting control circuit.

5. The pixel circuit according to claim 1, wherein the short circuit protection circuit comprises a fourth transistor and a fifth transistor, a control electrode of the fourth transistor is coupled to a first control line, a first electrode of the fourth transistor is coupled to a second electrode of the fifth transistor and the precharging circuit, a second electrode of the fourth transistor is coupled to a second control line, a control electrode of the fifth transistor is coupled to the light emitting control circuit and the light emitting device, and a first electrode of the fifth transistor is coupled to a third control line.

6. The pixel circuit according to claim 5, wherein a width-length ratio of the fourth transistor is the same as a width-length ratio of the fifth transistor, and a threshold voltage of the fourth transistor is the same as a threshold voltage of the fifth transistor.

7. The pixel circuit according to claim 1, wherein the precharging circuit comprises a sixth transistor, a seventh transistor, an eighth transistor and a second capacitor;

a first terminal of the second capacitor is coupled to the light emitting control circuit and a first electrode of the sixth transistor, a second terminal of the second capacitor is coupled to a second electrode of the eighth transistor and a first electrode of the seventh transistor;

a control electrode of the eighth transistor is coupled to an eighth control line and a first electrode of the eighth transistor is coupled to the short circuit protection circuit;

a control electrode of the seventh transistor is coupled to a fifth control line and a second electrode of the seventh transistor is coupled to a seventh control line; and a control electrode of the sixth transistor is coupled to a fourth control line and a second electrode of the sixth transistor is coupled to a sixth control line.

8. The pixel circuit according to claim 1, wherein the light emitting control circuit comprises a third transistor, a control electrode of the third transistor is coupled to the short circuit control circuit, a first electrode of the third transistor is coupled to the driving circuit, and a second electrode of the third transistor is coupled to the light emitting device.

9. The pixel circuit according to claim 1, wherein the driving circuit comprises a first transistor, a second transistor and a first capacitor;

a control electrode of the first transistor is coupled to a gate line, a first electrode of the first transistor is coupled to a data line, a second electrode of the first transistor is coupled to a first terminal of the first capacitor and a control electrode of the second transistor; and a first electrode of the second transistor is coupled to a first power terminal and a second terminal of the first capacitor, and a second electrode of the second transistor is coupled to the light emitting control circuit.

10. A display device, comprising the pixel circuit according to claim 1.

11. The display device according to claim 10, wherein an input terminal of the light emitting device is coupled to an output terminal of the light emitting control circuit and an input terminal of the short circuit control circuit, an output terminal of the light emitting device is coupled to a second power terminal;

an input terminal of the driving circuit is coupled to a first power terminal, an output terminal of the driving circuit is coupled to an input terminal of the light emitting control circuit; and an output terminal of the short circuit control circuit is coupled to a control terminal of the light emitting control circuit.

12. The display device according to claim 11, wherein the short circuit control circuit comprises a short circuit protection circuit and a precharging circuit coupled in series; during an operating phase of the light emitting device, when an input terminal signal of the light emitting device is lower than a threshold value, the short circuit protection circuit controls the light emitting control circuit to be turned off; and during a non-operating phase of light emitting device, the precharging circuit controls the light emission control device to be turned on.

13. A method for driving a pixel circuit, adopting the pixel circuit according to claim 1, the method for driving the pixel circuit comprising:

during an operating phase of the light emitting device, the driving circuit driving the light emitting device to emit light;

the short circuit control circuit obtaining the input terminal signal of the light emitting device and outputting the short circuit control signal according to the input terminal signal of the light emitting device, and according to the short circuit control signal, the light emitting control circuit controlling the connecting branch between the driving circuit and the light emitting device to be turned on and off.

14. The method for driving a pixel circuit according to claim 13, further comprising: during a non-operating phase of the light emitting device, the precharging circuit controlling the light emitting control circuit to be turned on.

15. The method for driving a pixel circuit according to claim 13, wherein an input terminal of the light emitting device is coupled to an output terminal of the light emitting control circuit and an input terminal of the short circuit control circuit, an output terminal of the light emitting device is coupled to a second power terminal;

an input terminal of the driving circuit is coupled to a first power terminal, an output terminal of the driving circuit is coupled to an input terminal of the light emitting control circuit; and an output terminal of the short circuit control circuit is coupled to a control terminal of the light emitting control circuit.

16. The method for driving a pixel circuit according to claim 15, wherein the short circuit control circuit comprises a short circuit protection circuit and a precharging circuit coupled in series; during an operating phase of the light emitting device, when an input terminal signal of the light emitting device is lower than a threshold value, the short circuit protection circuit controls the light emitting control circuit to be turned off; and during a non-operating phase of light emitting device, the precharging circuit controls the light emission control device to be turned on.

17. The method for driving a pixel circuit according to claim 16, wherein the short circuit protection circuit comprises a fourth transistor and a fifth transistor, a control electrode of the fourth transistor is coupled to a first control line, a first electrode of the fourth transistor is coupled to a second electrode of the fifth transistor and the precharging circuit, a second electrode of the fourth transistor is coupled to a second control line, a control electrode of the fifth transistor is coupled to the light emitting control circuit and the light emitting device, and a first electrode of the fifth transistor is coupled to a third control line.

18. The pixel circuit according to claim 1, wherein the light emitting control circuit comprises a third transistor, a control electrode of the third transistor is coupled to the short circuit control circuit, a first electrode of the third transistor is coupled to the driving circuit, and a second electrode of the third transistor is coupled to the light emitting device.

19. The pixel circuit according to claim 1 wherein the driving circuit comprises a first transistor, a second transistor and a first capacitor;

a control electrode of the first transistor is coupled to a gate line, a first electrode of the first transistor is coupled to a data line, a second electrode of the first transistor is coupled to a first terminal of the first capacitor and a control electrode of the second transistor; and a first electrode of the second transistor is coupled to a first power terminal and a second terminal of the first capacitor, and a second electrode of the second transistor is coupled to the light emitting control circuit.

* * * * *